United States Patent [19]

Madonio et al.

[11] Patent Number: 4,539,775

[45] Date of Patent: Sep. 10, 1985

[54] LOCKING MECHANISM FOR VEHICLE DOOR

[75] Inventors: Andrew M. Madonio, Holly; Michael H. Gulick, Pontiac, both of Mich.

[73] Assignee: General Motors Corporation, Detroit, Mich.

[21] Appl. No.: 597,608

[22] Filed: Apr. 6, 1984

[51] Int. Cl.[3] ..... E05F 7/02

[52] U.S. Cl. ..... 49/255; 49/281; 49/394

[58] Field of Search ..... 49/255, 256, 281, 280, 49/334–337, 394

[56] References Cited

U.S. PATENT DOCUMENTS 3,373,529 3/1968 Ingham ..... 49/334 X
3,888,045 6/1975 Piegza ..... 49/280 X
4,308,691 1/1982 Horn ..... 49/255
4,490,941 1/1985 Mamach ..... 49/334 X

FOREIGN PATENT DOCUMENTS 2320570 11/1974 Fed. Rep. of Germany ..... 49/334

*Primary Examiner*—Philip C. Kannan
*Attorney, Agent, or Firm*—Patrick M. Griffin

[57] ABSTRACT

A locking mechanism for coach door leaves of the type which are rotated and then driven axially upward by a powered door operating mechanism. Male and female locking bodies at the top of the door leaf shaft move together and apart axially without being radially engaged as the door leaf moves in or out at final closed position. Any external outward pushing force on the door leaf radially engages the locking bodies to prevent door opening.

2 Claims, 4 Drawing Figures

LOCKING MECHANISM FOR VEHICLE DOOR

This invention relates to vehicle door locking mechanisms and specifically to an improved locking mechanism for use in combination with a door leaf which is moved by a rotatably driven axial shaft.

BACKGROUND OF THE INVENTION

Leaf type doors, especially for a bus, are often moved between open and closed positions by a rotatably driven axial shaft joined to the door leaves by link arms to produce a swinging opening and closing movement. Generally, the power source, at the end of the closing movement of the door leaf, produces an axial upward movement of the shaft and leaf. This movement serves to seal the top of door leaf, and may also, through the use of a suitable locking mechanism, serve to lock the door leaves against being accidentally pushed outwardly.

The U.S. patent to Horn, U.S. Pat. No. 4,308,691, shows a vehicle door of the general type described above which incorporates a locking mechanism consisting of a pair of wedge members, one attached to the door frame and one attached to the door leaf. At the end of the door closing cycle, when the shaft is moved upwardly by the driving mechanism, the two wedges frictionally engage to lock the door leaves against any opening movement caused by a push from the inside. There are several drawbacks to such a design. Because of the frictional engagement between the locking members, a friction reducing insert is necessary. This frictional engagement would, of course, tend to retard the upward movement of the shaft and put extra strain on the power source. In addition, any binding therein might interfere with the downward movement of the shaft which could create a problem in opening the doors manually in the event of power source failure. Furthermore, it could be difficult to retro-fit such a locking mechanism into door opening mechanisms for bus body designs involving curved doors and door frames.

SUMMARY OF THE INVENTION

The improved locking mechanism of the invention operates in conjunction with the axially upward lifting motion of the vehicle door shaft, but causes no frictional interference therewith. In addition, the mechanism is easily retro-fitted to any such door which has an axial shaft. Further, the locking mechanism will not interfere with the opening of the door in the event of failure of the door opener's power source, and, as an additional feature, a spring mechanism may be added to the locking mechanism to assist therewith.

In the embodiment disclosed, the improved locking mechanism includes a pair of locking bodies with cooperating male and female locking members thereon. A first locking body joined to the top of the axial shaft includes a generally cylindrical base and an annular shoulder having a pair of arcuate slots therein. A rod of smaller diameter extends upwardly from the shoulder. A second locking body includes a cylindrical casing which is attached to the vehicle near the top of the door frame concentrically with the first locking member. The rod on the first locking member passes through the second locking member and through a spherical bearing therein to complete the rotational attachment of the top of the shaft to the vehicle. At the bottom of the cylindrical casing of the second locking member are formed a pair of arcuate teeth shaped similar to, but smaller than, the slots on the first locking member shoulder.

As the door is moved from an opened to a closed position, the axial shaft and the first locking member rotate relative to the stationary second locking member as the rod turns within the cylindrical casing. At the end of the door's closing movement, when the axial upward lifting is induced on the shaft, the teeth on the second locking member move within the slots of first locking members with clearance and without binding or frictional engagement. The upward motion stops when the bottom of the teeth hit the bottom of the slots. If a force from inside the vehicle pushes outwardly on the door leaf, thus tending to move the axial shaft as well, the teeth engage the slots, and opening will be prevented. In the event of failure of the power source which drives the shaft, the shaft can simply fall down under its own weight because there is no binding or frictional engagement of the locking mechanism. This motion may, if desired, be assisted by a spring.

It is, therefore, an object of the invention to provide an improved locking mechanism which operates without any friction or binding and does not affect the operation of the door.

It is another object of the invention to provide such a locking mechanism which is engaged only when an external force is applied to the inside of the door.

It is yet another object of the invention to provide such a locking mechanism which may be easily retro-fitted to any door design having an axial shaft rotatably attached to the vehicle.

It is a more particular object of this invention to provide an improved locking mechanism for use in combination with an axial shaft attached to a bus door and mechanically rotatably driven at the lower end thereof to swing the door between open and closed positions and mechanically axially upwardly driven a predetermined distance as the door reaches closed position, wherein the locking mechanism comprises a first locking body which is rigidly attached to the bus and includes thereon an axially directed male locking member having an axial length slightly less than said predetermined distance, a second locking body which is rigidly attached to the shaft and includes thereon an axially directed female slot sized slightly larger than the male locking member and oriented relative to the male locking member so as to be axially opposed thereto as the door leaf reaches closed position, and bearing means which rotatably interconnects the locking bodies together to allow relative rotation therebetween coaxially with the shaft axis as the door opens and closes, and which allows relative axial movement between the locking bodies at least equal to said predetermined distance as the door reaches closed position, so that the male locking member may enter the female slot with clearance and without binding due to the larger sizing of the female slot as the first and second locking bodies are moved axially together by the mechanically axially upwardly driven shaft when the door reaches the closed position whereat manual forces are thereby prevented from moving the door from closed to open position when said male locking member engages a portion of the female slot.

DESCRIPTION OF THE PREFERRED EMBODIMENT

These and other objects of the invention will appear from the following written description and drawings in which.

Figure 1:
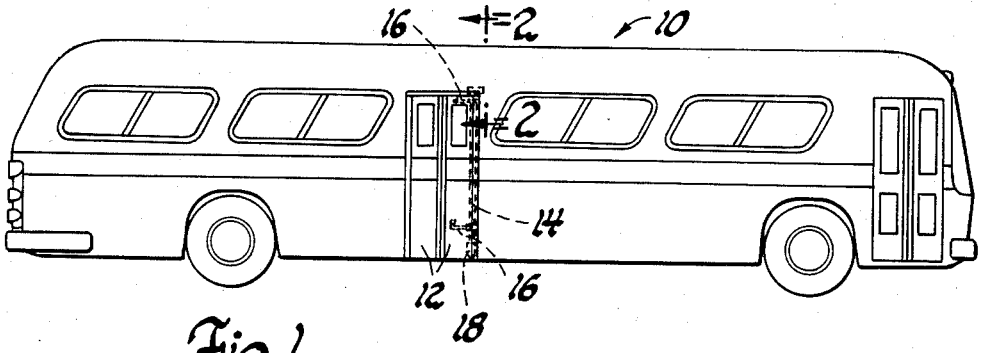
FIG. 1 is a side view of a vehicle incorporating a locking mechanism of the invention.

Referring first to FIG. 1, a bus vehicle 10 has a pair of swingable door leaves 12 which swing in and out of the vehicle between closed and open positions, driven by an axial shaft 14 and link arms 16 which are in turn rotatably turned by a power source 18. These elements are conventional and are not further described.

Figure 2:
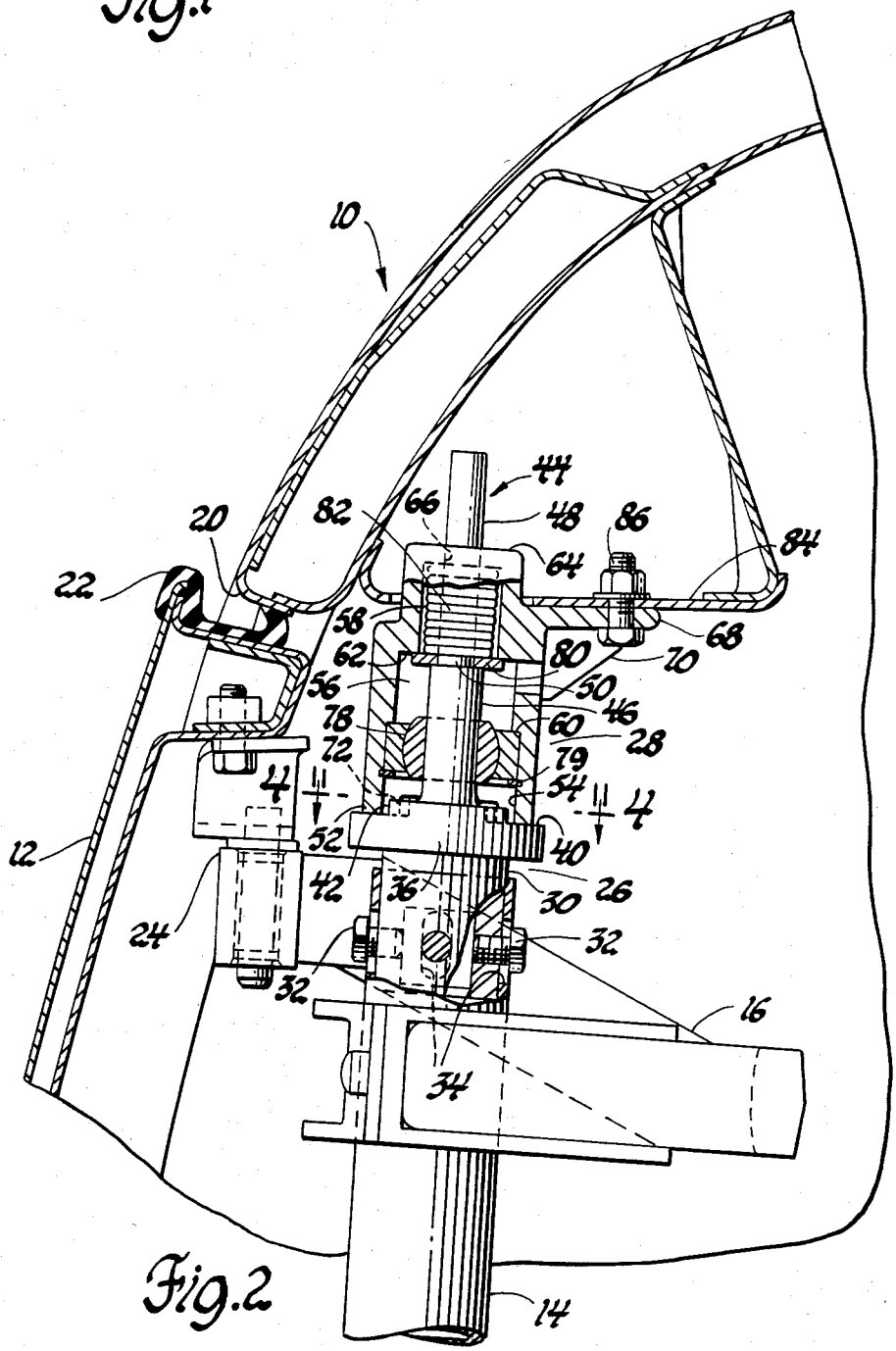
FIG. 2 is a view taken along the line 2—2 of FIG. 1 and enlarged to show the elements of the locking mechanism in the closed or locked position.

Referring next to FIG. 2, leaves 12 fit within a door frame 20 against which door seals 22 are compressed. A pivot mechanism 24 joins each door leaf 12 to link arm 16. Power source 18 is adapted to swing the door leaf toward final closed position and impart an axial upward lifting to axial shaft 14 for a predetermined distance. Such a power source may be a conventional push-piston drive of the type used in the Horn, U.S. Pat. No. 4,308,691, patent. It is this motion which is incorporated to create the locking action of the improved locking mechanism of the invention, as well as compressing seals 22.

Referring to FIG. 2, the locking mechanism of the invention includes a first locking body designated generally at 26 and a second locking body designated generally at 28. Locking body 26 includes a cylindrical base 30 set into the top of shaft 14 and held thereto by bolts 32 run through elongated adjusting holes 34. Typically, shaft 14 will be hollow and may be simply cut off and base 30 inserted. Integral with base 30 is an annular shoulder 36 of a larger diameter which, as may be seen by referring to FIG. 4, includes a pair of arcuate, axially directed slots 38 covering most of the circumference of shoulder 36. Each slot 38 has a flat base 40 and generally perpendicular sides 42. Extending coaxially with the axis of shaft 14 upwardly from the center of base 30 is an elongated rod designated generally at 44 which has lower and upper portions 46 and 48 respectively which merge across a shoulder 50. Locking body 26 may be a machined piece or casting as desired.

Still referring to FIG. 2, the second locking body 28 comprises a hollow cylindrical casing 52. Casing 52 has an interior comprised of three consecutive cylindrical cavities 54, 56 and 58 which open to one another across shoulders 60 and 62 respectively. Casing 52 has an end cap 64 at the top which has a hole 66 through which upper portion 48 of rod 44 is receivable and an integral attachment flange 68 on the side thereof. Although not visible in the drawing, flange 68 is generally semi-circular and is strengthened in its juncture with casing 52 by strengthening ribs 70, although any shape would suffice. At the bottom of casing 52 are a pair of axially directed teeth or male locking members 72 which, as best visible in FIG. 4, comprise arcuate segments of a size slightly smaller than arcuate female slots 38. Each tooth 72 has a flat base 74, flat sides 76 and a length slightly less than the predetermined distance shaft 14 is moved by power source 18.

Locking bodies 26 and 28 are rotatably interconnected by a spherical bearing 78 held in cavity 54 against shoulder 60 by a snap ring 79. Rod portion 46 slides freely through the center of bearing 78 and rod portion 48 slides freely through end cap hole 66, thus allowing bodies 26 and 28 to move axially together and apart as shaft 14 is moved axially. A washer 80 seated on shoulder 50 compresses a spring 82 within cavity 58 against end cap 64 to maintain a downward bias on locking body 26. Flange 68 is rigidly attached to a mounting bracket 84 near the top of door frame 20 by nut and bolt assemblies, one of which is visible at 86. Thus, the rotatably interconnected bodies 26 and 28 cooperate to rotatably attach shaft 14 to bus 10.

Figure 3:
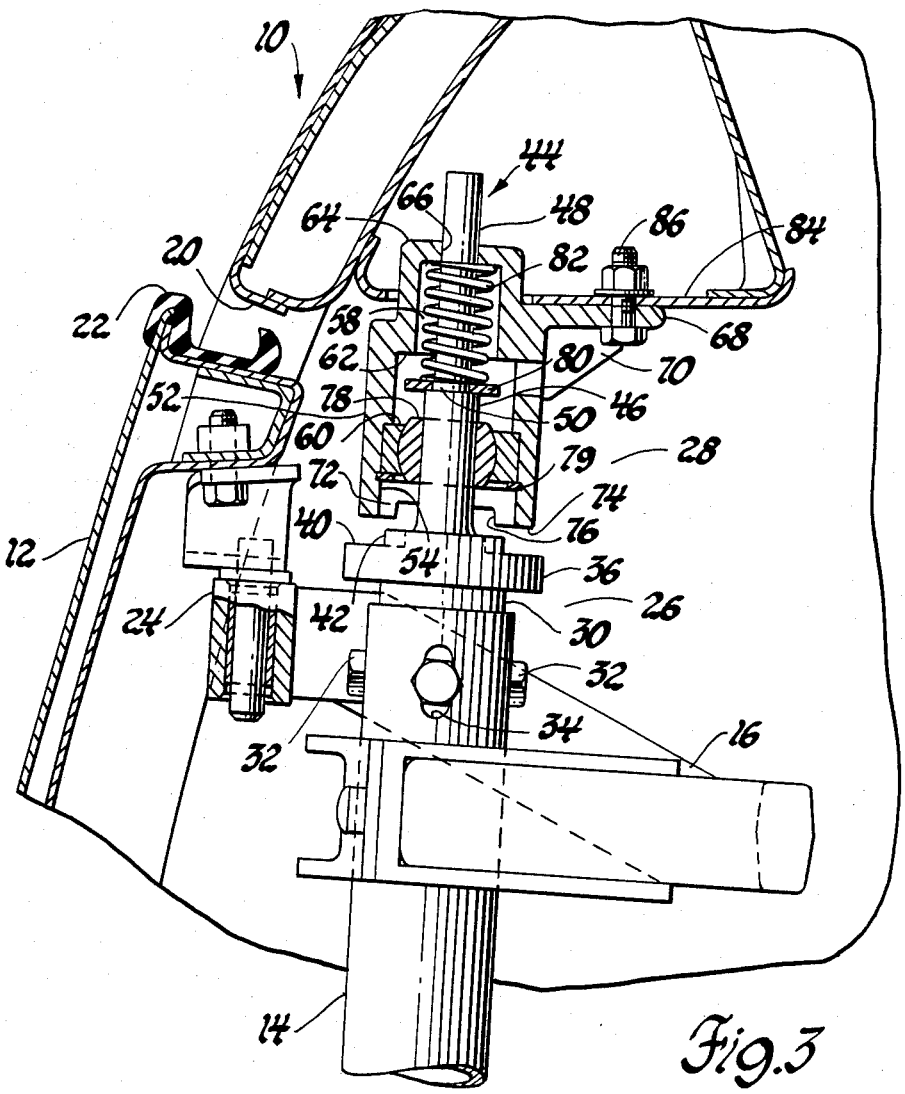
FIG. 3 is a view from the same perspective as FIG. 2 showing the locking mechanism just as the door opening motion begins.
Figure 4:
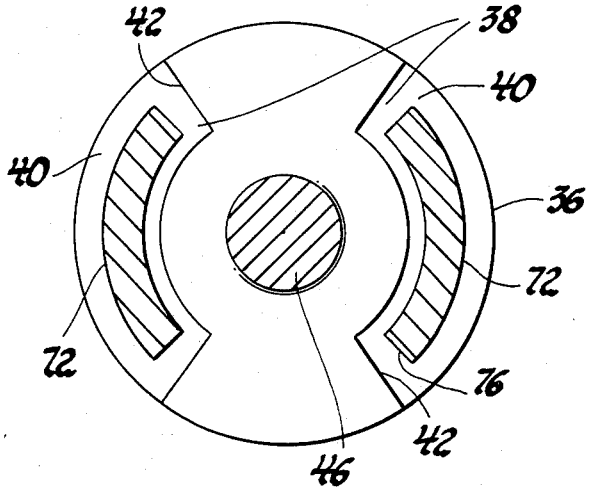
FIG. 4 is a view taken along the line 4—4 of FIG. 2.

Operation of the locking mechanism of the invention will now be described with reference to FIGS. 2 and 3. Referring first to FIG. 2, in a fully closed position axial shaft 14 has been lifted up the predetermined distance by power source 18 and male locking teeth 72 seat within arcuate female slots 38 with clearance, as best seen in FIG. 4. Base 30 is adjusted up or down by bolt-slot connections 32, 34 to assure that the teeth bases 74 just seat on slot bases 40. Spring 82 is compressed upward by washer 80 which just touches shoulder 62. It will be apparent that teeth 72 and slots 38 are not frictionally engaged at all, but if door leaf 12 were pushed from the inside outward, shaft 14, through the action of link arm 16, would be rotated slightly, thus bringing the sides 76 of teeth 72 into engagement with the sides 42 of arcuate slots 38. This would prevent door opening. Referring to FIG. 3, as door leaves 12 begin to open and axial shaft 14 drops down, teeth 72 and slots 38 disengage without rubbing and door leaves 12 may open in conventional fashion. As door leaves 12 swing back toward the FIG. 2 closed position, male teeth 72 move axially back within female slots 38 with clearance as power source 18 moves shaft 14 back up. Casing 52 may be adjusted to assure that teeth 72 are exactly axially opposite to slots 38 at this point of the closing cycle.

Spring 82 is chosen to provide a sufficient force to assist and assure the axial downward movement of shaft 14 should power source 18 fail, thus assisting the natural gravitation action to release the doors 12 for manual opening from the inside. It will be understood that the locking mechanism of the invention operates entirely without affecting the regular opening and closing action of doors 12. The locking mechanism may be easily retro-fitted on a bus door by replacing the rotatable shaft support at the top of the shaft with the first and second locking bodies of this invention. It is to be understood that the invention is capable of other embodiments and it is not to be limited to the embodiment disclosed herein.

The embodiments of the invention in which an exclusive property or privilege is claimed are defined as follows:

1. An improved locking mechanism for use in combination with a vehicle door or the like of the type having a door leaf joined to an axial shaft rotatably attached to the vehicle and rotatably driven at the lower end thereof by a power source to swing the door leaf between open and closed positions, said power source moving the shaft axially upwardly a predetermined distance as the door leaf reaches closed position, comprising, a first locking body rigidly attached to the vehicle or to the upper end of the shaft and including thereon at least one axially directed male locking member having an axial length slightly less than said predetermined distance, a second locking body rigidly attached to the other of the vehicle or the upper end of the shaft and including thereon at least one axially directed female slot sized slightly larger than the male locking member and oriented relative to the male locking member so as to be axially opposed thereto as the door leaf reaches closed position, bearing means rotatably interconnecting the locking bodies together to allow relative rotation therebetween coaxially with the shaft axis as the door leaf opens and closes, said bearing means allowing a relative axial movement between the locking bodies at least equal to said predetermined distance as the door leaf reaches closed position, the male locking member entering the female slot with clearance due to the larger sizing of the female slot as the first and second locking bodies move axially together when the door leaf reaches the closed position, so that the power source may swing the door leaf between open and closed positions without binding, forces other than the power source tending to move the door leaf from closed to open position by rotating the shaft slightly until the male locking member and the female slot are brought into engagement, thereby preventing opening of the door leaf by the other force.

2. An improved locking mechanism for use in combination with a vehicle door or the like of the type having a door leaf joined to an axial shaft rotatably attached to the vehicle and rotatably driven at the lower end thereof by a power source to swing the door leaf between open and closed positions, said power source moving the shaft axially upwardly a predetermined distance as the door leaf reaches closed position, comprising, a first locking body rigidly attached to the vehicle or to the upper end of the shaft and including thereon a plurality of axially directed teeth having an axial length slightly less than said predetermined distance, a second locking body rigidly attached to the other of the vehicle or the upper end of the shaft and including thereon a plurality of axially directed slots sized slightly larger than the teeth and oriented so as to be axially opposed thereto as the door leaf reaches closed position, bearing means rotatably interconnecting the locking bodies together to allow relative rotation therebetween coaxially with the shaft axis as the door leaf opens and closes, said bearing means allowing a relative axial movement between the locking bodies at least equal to said predetermined distance as the door leaf reaches closed position, the teeth entering the slots with clearance due to the larger sizing of the slot as the first and second locking bodies move axially together when the door leaf reaches the closed position, so that the power source may swing the door leaf between open and closed positions without binding, forces other than the power source tending to move the door leaf from closed to open position by rotating the shaft slightly until the teeth and the slots are brought into engagement, thereby preventing opening of the door leaf by the other force.

* * * * *